US012162571B2

(12) United States Patent
Bleakley

(10) Patent No.: US 12,162,571 B2
(45) Date of Patent: Dec. 10, 2024

(54) BOAT AND STRUCTURAL REINFORCEMENT THEREFOR

(71) Applicant: Joseph Eric Bleakley, Jacobs Well (AU)

(72) Inventor: Joseph Eric Bleakley, Jacobs Well (AU)

( * ) Notice: Subject to any disclaimer, the term of this patent is extended or adjusted under 35 U.S.C. 154(b) by 0 days.

(21) Appl. No.: 17/794,443

(22) PCT Filed: Jan. 21, 2020

(86) PCT No.: PCT/AU2020/050029
§ 371 (c)(1),
(2) Date: Jul. 21, 2022

(87) PCT Pub. No.: WO2021/146765
PCT Pub. Date: Jul. 29, 2021

(65) Prior Publication Data
US 2023/0046016 A1 Feb. 16, 2023

(51) Int. Cl.
*B63B 5/24* (2006.01)

(52) U.S. Cl.
CPC ..... *B63B 5/24* (2013.01); *B63B 2005/242* (2013.01); *B63B 2005/245* (2013.01)

(58) Field of Classification Search
CPC ..... B63B 5/24; B63B 2005/242; B63B 2005/245
See application file for complete search history.

(56) References Cited

U.S. PATENT DOCUMENTS

| | | | | |
|---|---|---|---|---|
| 1,531,704 | A * | 3/1925 | Langfelder | B64C 35/00 114/291 |
| 3,080,267 | A | 3/1963 | Schmalz | |
| 4,660,498 | A | 4/1987 | Madison | |
| 4,892,054 | A | 1/1990 | Davidson | |
| 5,036,788 | A | 8/1991 | Unger | |
| 5,253,607 | A | 10/1993 | Chen | |
| 5,277,145 | A | 1/1994 | Hordis | |
| 6,007,391 | A | 12/1999 | Eilert | |
| 6,182,591 | B1 * | 2/2001 | Whitesides | B63B 3/40 114/355 |

(Continued)

FOREIGN PATENT DOCUMENTS

| | | |
|---|---|---|
| EP | 0274461 A2 | 7/1988 |
| EP | 0297801 A2 | 1/1989 |
| EP | 1880841 A2 | 1/2008 |

OTHER PUBLICATIONS

International Search Report and Written Opinion in PCT/AU2020/050029. Mailed Mar. 16, 2020. 5 pages.

(Continued)

*Primary Examiner* — Anthony D Wiest
(74) *Attorney, Agent, or Firm* — Meunier Carlin & Curfman LLC

(57) ABSTRACT

A support for inclusion internally within a plastic boat body to structurally reinforce the plastic boat body is provided. The support may comprise a support plate and a support brace. Also provided is a reinforced component for a plastic boat body, comprising an interior support; and one or more plastic exterior walls. Plastic boats comprising supports and reinforced components are also provided. Further provided are associated kits, systems, and methods.

19 Claims, 13 Drawing Sheets

(56) References Cited

U.S. PATENT DOCUMENTS

| | | | | |
|---|---|---|---|---|
| 2006/0003044 | A1* | 1/2006 | DiNello | B29C 44/08 425/412 |
| 2012/0282429 | A1* | 11/2012 | DiNello | B29C 41/18 296/181.3 |

OTHER PUBLICATIONS

Examination Report No. 1 dated Oct. 12, 2022, from IP Australia for Australian Application 2020425314, 4 pages.
Notice of Acceptance dated Jan. 6, 2023, from IP Australia for Australian Application 2020425314, 4 pages.
European Search Report dated Dec. 4, 2023 from corresponding European Patent Application No. 20916149.6, 9 pages.

* cited by examiner

BOAT AND STRUCTURAL REINFORCEMENT THEREFOR

FIELD

The present invention relates to boats. More particularly, the invention relates (but is not limited) to a reinforced component for plastic boats, and plastic boats comprising the reinforced component.

BACKGROUND

Plastic boats can have advantages as compared to boats constructed from other materials such as fiberglass, aluminium, and timber. Plastic boats are typically resistant to corrosion, rusting, rotting, and osmosis. Generally, plastic has a lower specific gravity than water and, accordingly, plastic boats may continue to float even where punctured or damaged. Plastics are typically stronger and more durable than other materials used for boat construction; for example, plastic materials used for boat construction typically have about five times the impact strength of fiberglass. Plastic is also generally relatively easy to repair, if damaged. Additionally, plastic boats typically flex and absorb force from water effectively, which can give a softer and smoother ride for passengers.

Certain typical disadvantages of plastic boats exist. The inherent flexibility of plastic boats, while offering softer and smoother transport, can be a considerable problem when heavy objects, particularly motors, are attached to such boats. This also generally limits the size of motor that can be used with plastic boats, relative to boats constructed using other materials. Additionally, plastic boats are typically more difficult to modify or add accessories to, as compared to boats constructed from other materials. In this respect, most plastic boats use a double skin, which can assist with providing rigidity and buoyancy. However, this arrangement makes modifying and adding accessories particularly difficult, as skin typically needs to be cut into and a backing plate added, so that the accessory can be attached. A cover is then typically required to re-seal the skin, in order to preserve buoyancy.

SUMMARY

A first aspect of the present invention broadly provides a support for, or suitable for, a plastic boat body. Suitably, the support is capable of structurally reinforcing a plastic boat body, or a part thereof.

In embodiments, the support of the first aspect is for inclusion, at least in part, internally within a plastic boat body. In embodiments, the support is for inclusion, in its entirety, internally within a plastic boat body.

The support of the first aspect will suitably be formed from material having certain greater or enhanced mechanical properties, relative to plastic typically used for construction of a plastic boat body.

In embodiments, the support is formed from material having greater or enhanced mechanical load resistance, such as resistance to bending, shear, and/or torsion, relative to plastic typically used for construction of a plastic boat body. In embodiments, the support is formed from a material having greater or enhanced resistance to bending, shear, and/or torsion relative to low density polyethylene (LDPE), medium density polyethylene (MDPE), high-density polyethylene (HDPE), and/or linear low-density polyethylene (LLDPE).

In embodiments, the support of the first aspect comprises, consists essentially of, or consists of a material selected from metal; reinforced plastic; composite material; and synthetic fibre.

In embodiments, the support of the first aspect comprises, consists essentially of, or consists of metal. In embodiments, the metal is aluminium or an aluminium alloy.

Suitably, the support of the first aspect comprises a support body. In embodiments, the support, or a body thereof, comprises a support plate. In embodiments, the support plate comprises, consists essentially of, or consists of a material selected from metal; reinforced plastic; composite material; and synthetic fibre. In embodiments the support plate comprises, consists essentially of, or consists of metal. In embodiments, the metal is aluminium or an aluminium alloy.

In embodiments, the support plate of the support of the first aspect has a longer dimension and a shorter dimension. In embodiments, the support is a substantially rectangular support plate, having a longer edge and a shorter edge.

The support plate of the support of the first aspect may comprise one or more apertures.

In embodiments, one or more apertures of the support plate are structural apertures. The one or more structural apertures of the support plate may be substantially circular structural apertures. In embodiments, the support plate comprises a plurality of structural apertures. In embodiments, the plurality of structural apertures of the support plate are substantially evenly spaced. In an embodiment, the structural apertures occupy at least about 20%, 30%, 40%, 50%, or 60% of a total area defined by the support plate.

In embodiments, one or more apertures of the support plate are connection apertures. The one or more connection apertures of the support plate may be substantially circular apertures. In embodiments, the connection apertures are located towards a first longer edge of the support plate. In embodiments, the connection apertures comprise at least one larger connection aperture; and at least one smaller connection aperture. In embodiments, the connection apertures comprise two smaller connection apertures flanked by two larger connection apertures.

In embodiments, the support of the first aspect, or a body thereof, comprises a support brace. In embodiments, the support brace is a support bracket. In embodiments, the support brace comprises, consists essentially of, or consists of a material selected from metal; reinforced plastic; composite material; and synthetic fibre. In embodiments, the support brace comprises, consists essentially of, or consists of metal. In embodiments, the metal is aluminium or an aluminium alloy.

In embodiments, the support brace is an elongated support brace. In embodiments, the support brace is positioned towards a first longer edge of a support plate of the support. In embodiments, the support brace extends between one shorter edge of the support plate and another shorter edge of the support plate. In embodiments, the support brace of the support projects laterally from the support plate of the support.

A second aspect of the invention provides a reinforced component of, for, or suitable for a boat body, wherein the reinforced component comprises an interior support; and one or more exterior panels or walls.

In embodiments of the second aspect, the reinforced component is, or is for, a stern of a boat body. In embodiments of the second aspect, the reinforced component is, or is for, a transom of a boat body.

In embodiments, the interior support of the reinforced component of the second aspect comprises, consists essentially of, or consists of a material selected from metal; reinforced plastic; composite material; and synthetic fibre. In embodiments, the interior support comprises, consists essentially of, or consists of metal. In embodiments, the metal is aluminium or an aluminium alloy.

In embodiments, the interior support of the reinforced component of the second aspect, or a body thereof, comprises an interior support plate. In embodiments, the interior support plate comprises, consists essentially of, or consists of a material selected from metal; reinforced plastic; composite material; and synthetic fibre. In embodiments, the interior support plate comprises, consists essentially of, or consists of metal. In embodiments, the metal is aluminium or an aluminium alloy.

In embodiments, the interior support plate has a longer dimension and a shorter dimension. In embodiments, the interior support plate is a substantially rectangular interior support plate, having a longer edge; and a shorter edge.

The interior support plate of the interior support of the reinforced component of the second aspect may comprise one or more apertures.

In embodiments, one or more apertures of the interior support plate are structural apertures. The one or more structural apertures of the interior support plate may be substantially circular apertures. In embodiments, the interior support plate comprises a plurality of substantially structural apertures. In embodiments, the plurality of structural apertures of the interior support plate are substantially evenly spaced. In an embodiment, the structural apertures occupy at least about 20%, 30%, 40%, 50%, or 60% of a total area defined by the interior support plate.

In embodiments, one or more apertures of the interior support plate are connection apertures. In embodiments, the one or more connection apertures of interior support plate are substantially circular apertures. In embodiments, the connection apertures are located towards a first longer edge of the interior support plate. In embodiments, the connection apertures comprise at least one larger connection aperture; and at least one smaller connection aperture. In embodiments, the connection apertures comprise two smaller connection apertures flanked by two larger connection apertures.

In embodiments, the interior support of the second aspect, or a body thereof, comprises an interior support brace. In embodiments, the interior support brace is an interior support bracket. In embodiments, the interior support brace comprises, consists essentially of, or consists of a material selected from metal; reinforced plastic; composite material; and synthetic fibre. In embodiments, the interior support brace comprises, consists essentially of, or consists of metal. In embodiments, the metal is aluminium or an aluminium alloy.

In embodiments, the interior support brace is an elongated brace. In embodiments, the interior support brace is located towards a first longer edge of an interior support plate of the interior support. In embodiments, the support brace extends between one shorter edge of the interior support plate and another shorter edge of the interior support plate. In embodiments, the interior support brace of the interior support projects laterally from the interior support plate of the interior support.

Suitably, the interior support of the reinforced component of the second aspect is the support of the first aspect.

In embodiments, the one or more exterior panels or walls of the reinforced component of the second aspect comprise, consist essentially of, or consist of plastic. In embodiments, the plastic is polyethylene. In embodiments, the plastic is polypropylene. In embodiments, the plastic is HDPE and/or LLDPE.

In embodiments, the reinforced component of the second aspect comprises two exterior walls, wherein the interior support is located between the two exterior walls. In an embodiment, an interior support plate of the interior support is located towards, adjacent, or against a first exterior wall. In an embodiment, an interior support brace of the interior support is located towards, adjacent, or against a second exterior wall.

In embodiments, the reinforced component of the second aspect comprises one or more reinforced component braces or guards. The one or more reinforced component braces or guards may increase strength, stiffness and/or durability of a reinforced component of the second aspect, and/or facilitate connection of an accessory, such as a boat motor, to the reinforced component.

In embodiments, the reinforced component of the second aspect comprises a first reinforced component guard attached or connected to a first exterior wall of the reinforced component. In embodiments, the reinforced component comprises a second reinforced component guard attached or connected to a second exterior wall of the reinforced component.

A third aspect of the invention provides a boat, or boat body, comprising the support of the first aspect. In embodiments, at least part of the support is included internally within the boat or boat body. In embodiments, the entire support is included internally within the boat or boat body.

In embodiments of the third aspect, the support of the first aspect, or a part thereof, is included internally within a stern of the boat or boat body. In embodiments, the support of the first aspect, or a part thereof, is included internally within a transom of the boat or boat body.

A fourth aspect of the invention provides a boat, or boat body, comprising the reinforced component of the second aspect incorporated therein.

In embodiments of the fourth aspect, the reinforced component of the second aspect forms at least part of a stern of the boat or boat body. In embodiments of the fourth aspect, the reinforced component of the second aspect forms at least part of a transom of the boat or boat body.

Suitably, the boat or boat body of the third or fourth aspect comprises, consists essentially of, or consists of plastic. In embodiments, the plastic is polyethylene. In embodiments, the plastic is polypropylene. In embodiments, the plastic is HDPE and/or LLDPE.

In embodiments, the boat or boat body of the third or fourth aspect comprises a handle at or towards a bow of the boat or boat body. In embodiments, the handle is integrally formed in the boat or boat body.

In embodiments, the boat or boat body of the third or fourth aspect comprises one or more attachment components.

Suitably, the attachment components are for connection of accessories to the boat or boat body. In embodiments, the attachment components are adapted to receive a bolt for connection of accessories. In embodiments, the boat, or boat body, of the third or fourth aspect comprises one or more attachment components that are or comprise threaded inserts.

In embodiments, the boat, or boat body of the third or fourth aspect comprises one or more removable components.

In embodiments, the boat or boat body comprises removable components that are, or are of, attachment components of the boat or boat body. In an embodiment, attachment components of the boat or boat body comprise removable components for engagement with a threaded insert. In embodiments, the removable components for engagement with a threaded insert are or include a protective insert cover.

In embodiments, the boat or boat body of the third or fourth aspect comprises removable components selected from a deck cover; a compartment cover; a seat; and/or a storage compartment.

A fifth aspect of the invention provides a kit comprising a boat or boat body of the third or fourth aspect; and one or more accessories for connection to the boat or boat body.

In an embodiment of the fifth aspect, the accessory for connection to the boat body comprises one or more of a davit connector; and a wheel, such as a dinghy wheel. In embodiments, the accessories are for connection to an attachment component of the boat or boat body.

In an embodiment of the fifth aspect, the accessory for connection to the boat body comprises a motor. In embodiments, the motor is for connection to a reinforced component guard of the boat or boat body.

A sixth aspect of the invention provides a system comprising a boat or boat body of the third or fourth aspect; and one or more accessories connected to the boat or boat body.

In embodiments of the sixth aspect, the accessory for connection to the boat body comprises one or more of a davit connector; and a wheel, such as a dinghy wheel. In embodiments, the accessories are for connection to attachment components of the boat or boat body.

In an embodiment of the sixth aspect, the accessory for connection to the boat body comprises a motor. In embodiments, the motor is connected to the boat or boat body to a reinforced component guard of the boat or boat body.

A seventh aspect of the invention provides a method of manufacturing a reinforced component of, for, or suitable for a boat body, including the step of placing one or more exterior walls around an interior support, to thereby manufacture the reinforced component.

In embodiments of the seventh aspect, the reinforced component that is manufactured is for a stern of a boat body. In embodiments, the reinforced component is for a transom of a boat body.

Suitably, the interior support around which one or more exterior walls are placed according to the method of the seventh aspect is the support of the first aspect.

In embodiments, the method of the seventh aspect includes the step of placing a first exterior wall and a second exterior wall around the interior support, to thereby manufacture the reinforced component.

In an embodiment, the method of the seventh aspect includes the step of placing a first exterior wall towards, adjacent, or against an interior support plate of the interior support, to thereby manufacture the reinforced component. In an embodiment, the method of the seventh aspect includes the step of placing a second exterior wall towards, adjacent, or against an interior support brace of the interior support, to thereby manufacture the reinforced component.

In embodiments, the method of the seventh aspect includes the step of placing one or more reinforced component brace or guards towards, adjacent, or against the interior support and/or the exterior walls, to thereby manufacture the reinforced component.

In an embodiment, the method of the seventh aspect includes the step of placing a first reinforced component guard towards, adjacent, or against an interior support plate and/or a first exterior wall of the reinforced component, to thereby manufacture the reinforced component. In an embodiment, the method of the seventh aspect includes the step of placing a second reinforced component guard towards, adjacent, or against an interior support brace and/or a second exterior wall of the reinforced component, to thereby manufacture the reinforced component.

An eighth aspect of the invention provides a reinforced component manufactured according to the method of the seventh aspect. Suitably, the reinforced component of the eighth aspect is the reinforced component of the second aspect.

A ninth aspect of the invention provides a method of manufacturing a boat or boat body, including the step of incorporating a reinforced component comprising an interior support and one or more exterior walls into a boat or boat body, to thereby manufacture the boat or boat body.

Suitably, the reinforced component incorporated into the boat or boat body body according to the method of the ninth aspect is the reinforced component of the second aspect or eighth aspect.

Suitably, the boat or boat body manufactured according to the method of the ninth aspect comprises, consists essentially of, or consists of plastic. In embodiments, the plastic is polyethylene. In embodiments, the plastic is polypropylene.

In embodiments, the method of the ninth aspect includes the step of incorporating a handle at or towards a bow of the boat or boat body, to thereby manufacture the boat or boat body.

In embodiments, the method of the ninth aspect includes the step of incorporating one or more attachment components into the boat or boat body for connection of accessories to the boat or boat body, to thereby manufacture the boat or boat body.

In embodiments, the method of the ninth aspect includes the step of incorporating one or more removable components into the boat or boat body, to thereby manufacture the boat or boat body. In embodiments, the method of the ninth aspect includes the step of incorporating one or more of a removable deck and/or deck cover, a removable compartment cover, a removable seat and/or seat cover, and a removable storage compartment into the boat or boat body, to thereby manufacture the boat or boat body.

A tenth aspect of the invention provides a boat or boat body manufactured according to the method of the ninth aspect. Suitably, the boat or boat body of the tenth aspect is the boat or boat body of the third or fourth aspect.

BRIEF DESCRIPTION OF THE DRAWINGS

The invention will be described hereinafter with reference to typical embodiments illustrated in the drawings, wherein.

DETAILED DESCRIPTION

Figure 1:
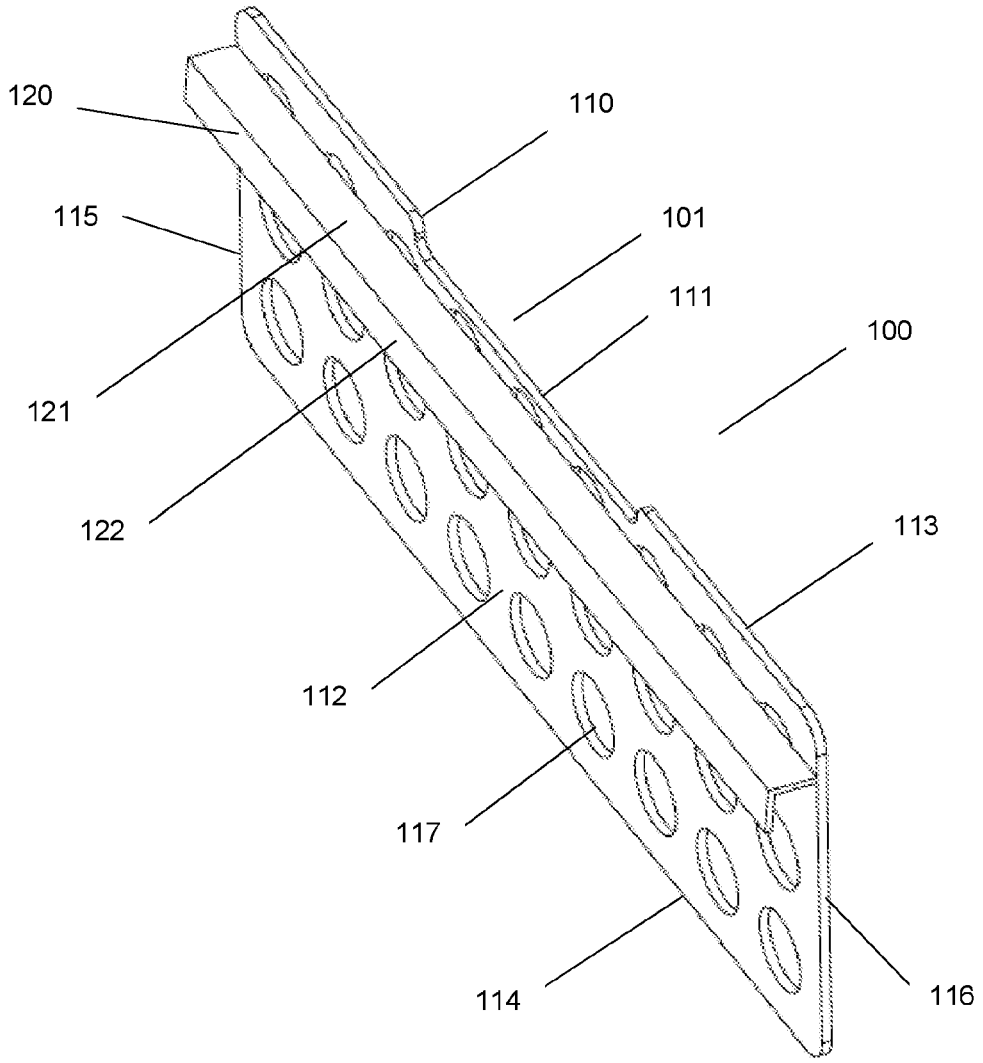
FIG. 1 sets forth a front perspective view of an embodiment of a support for inclusion internally within a plastic boat body, according to an aspect of the invention.
Figure 2:
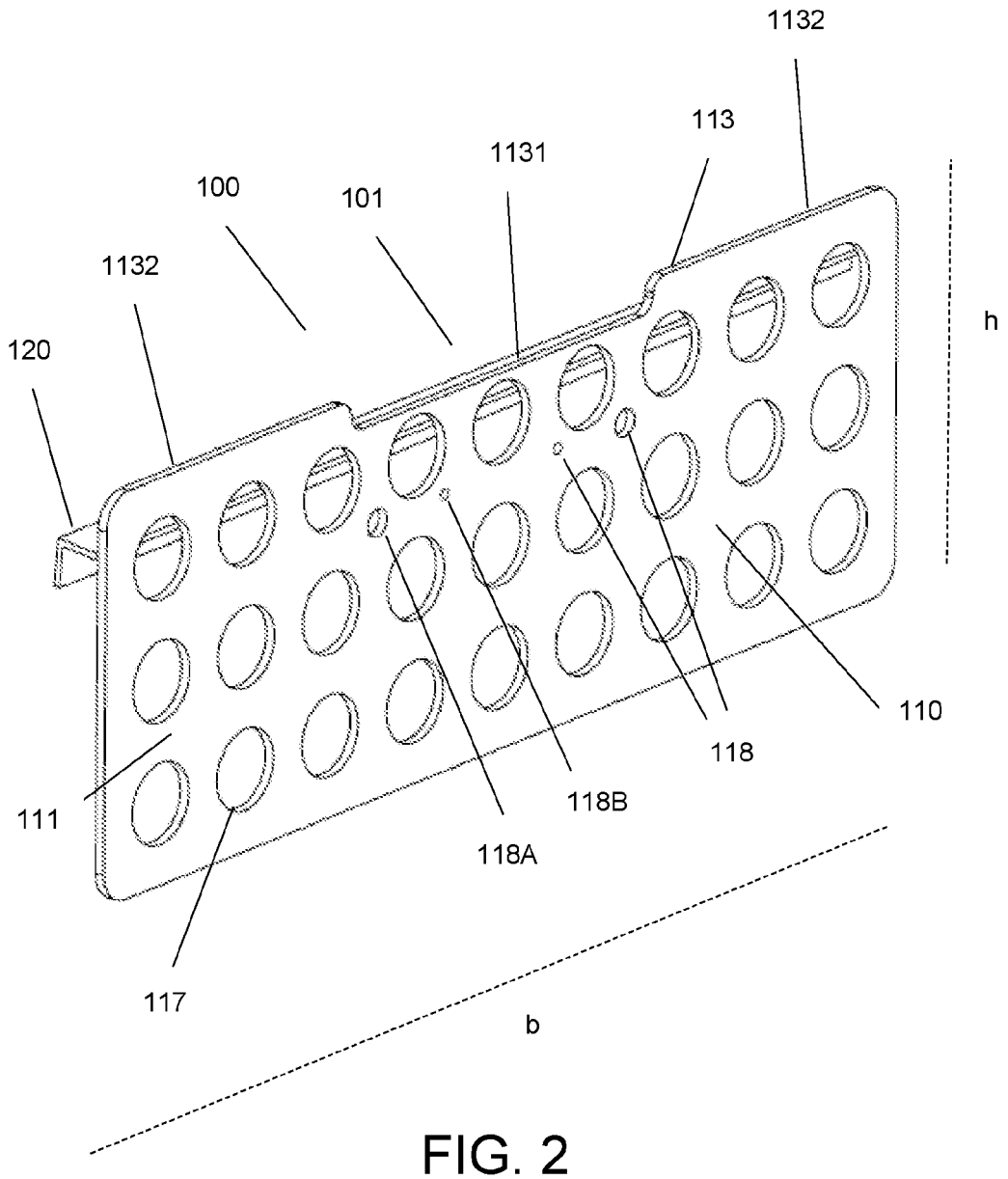
FIG. 2 sets forth a rear perspective view of the support of FIG. 1. Breadth (b) and height (h) dimensions of the support are shown with dashed lines.
Figure 3:
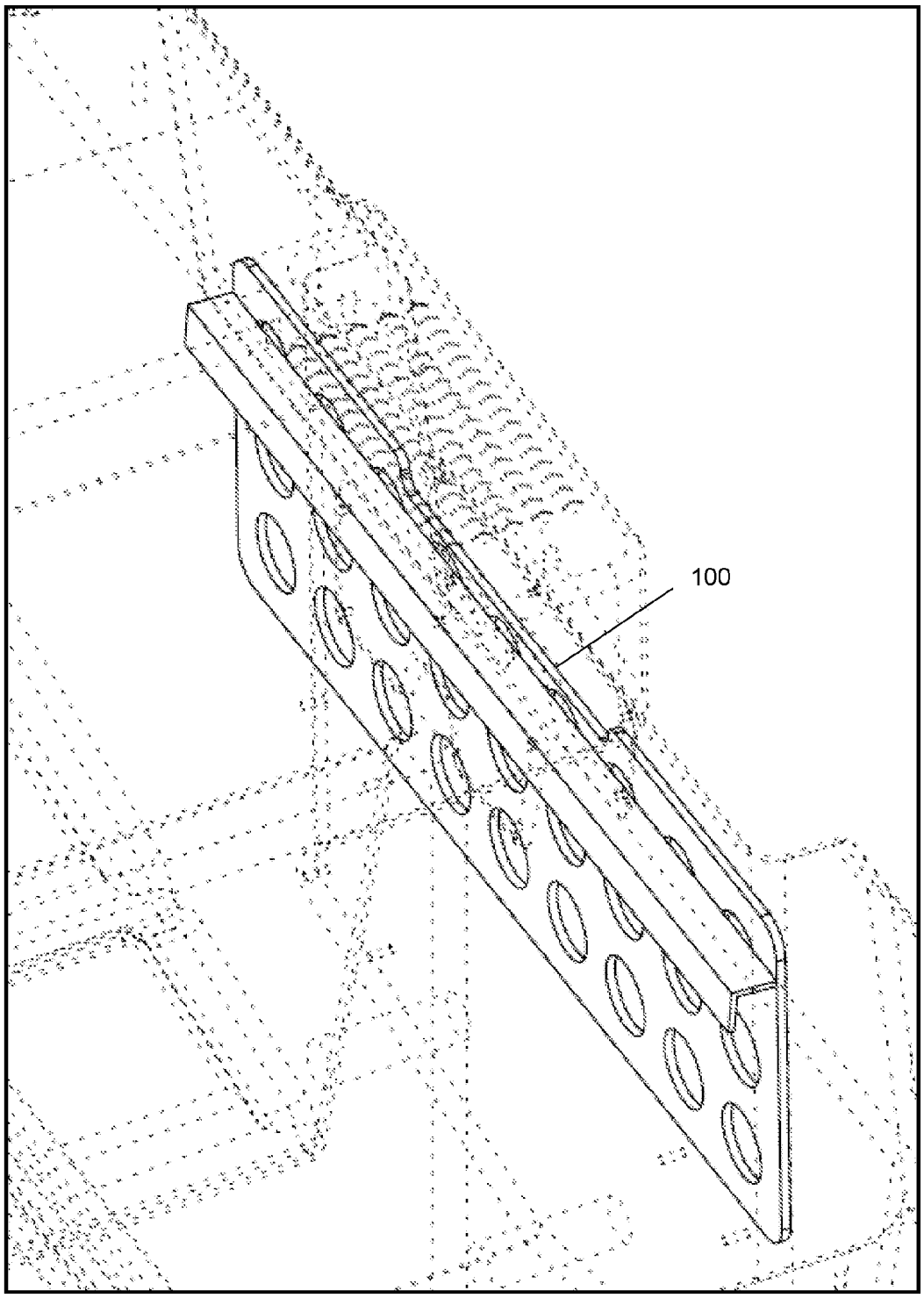
FIG. 3 sets forth a front perspective view of the position of the support within a reinforced transom. For illustrative purposes, exterior walls of the reinforced transom are rendered as dashed lines.
Figure 4:
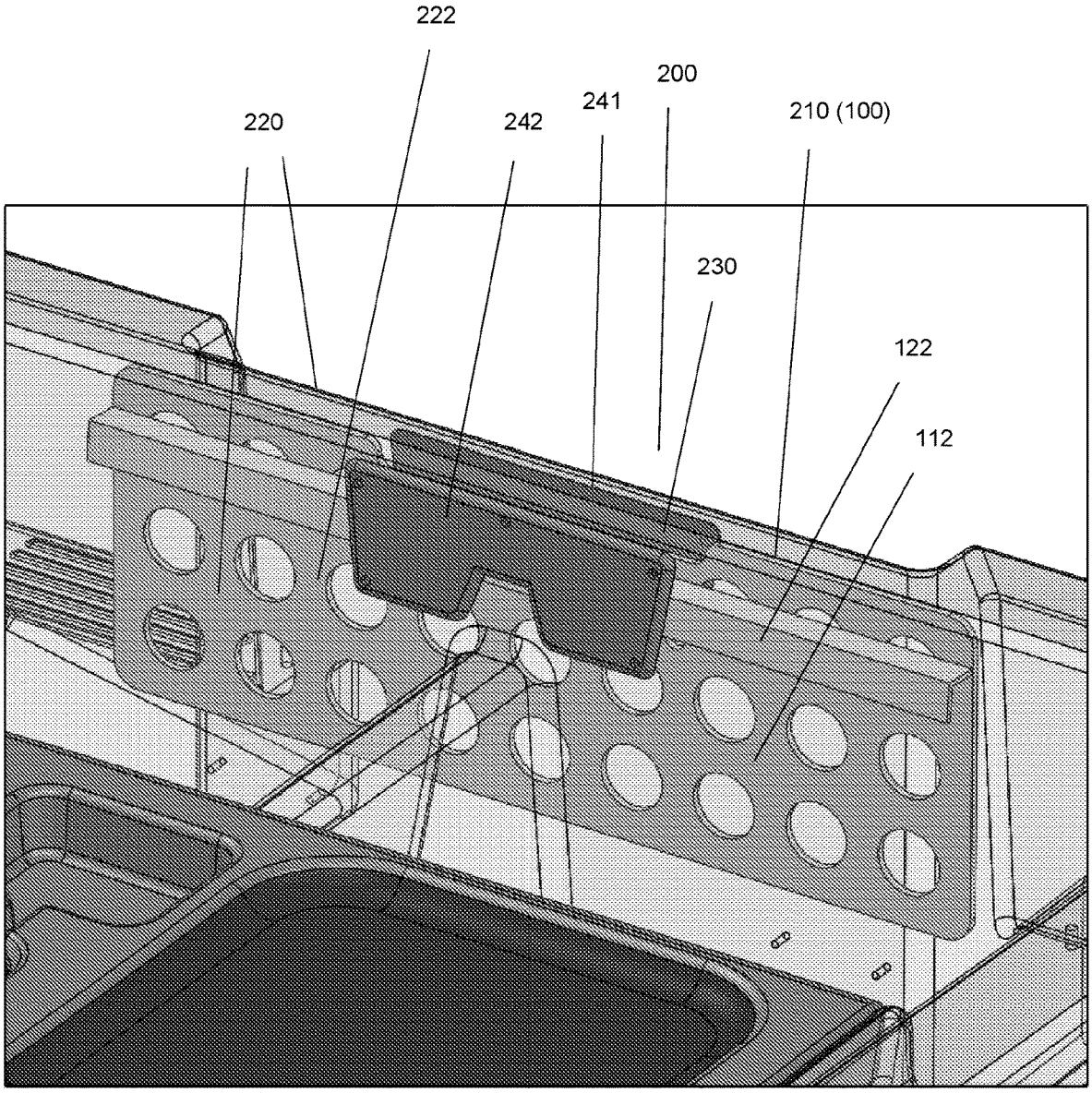
FIG. 4 sets a front perspective view of an embodiment of a reinforced transom of a boat body, according to an aspect of the invention. For illustrative purposes, the position of an interior support within the reinforced transom is shown by translucent rendering of exterior walls of the reinforced transom.
Figure 5:
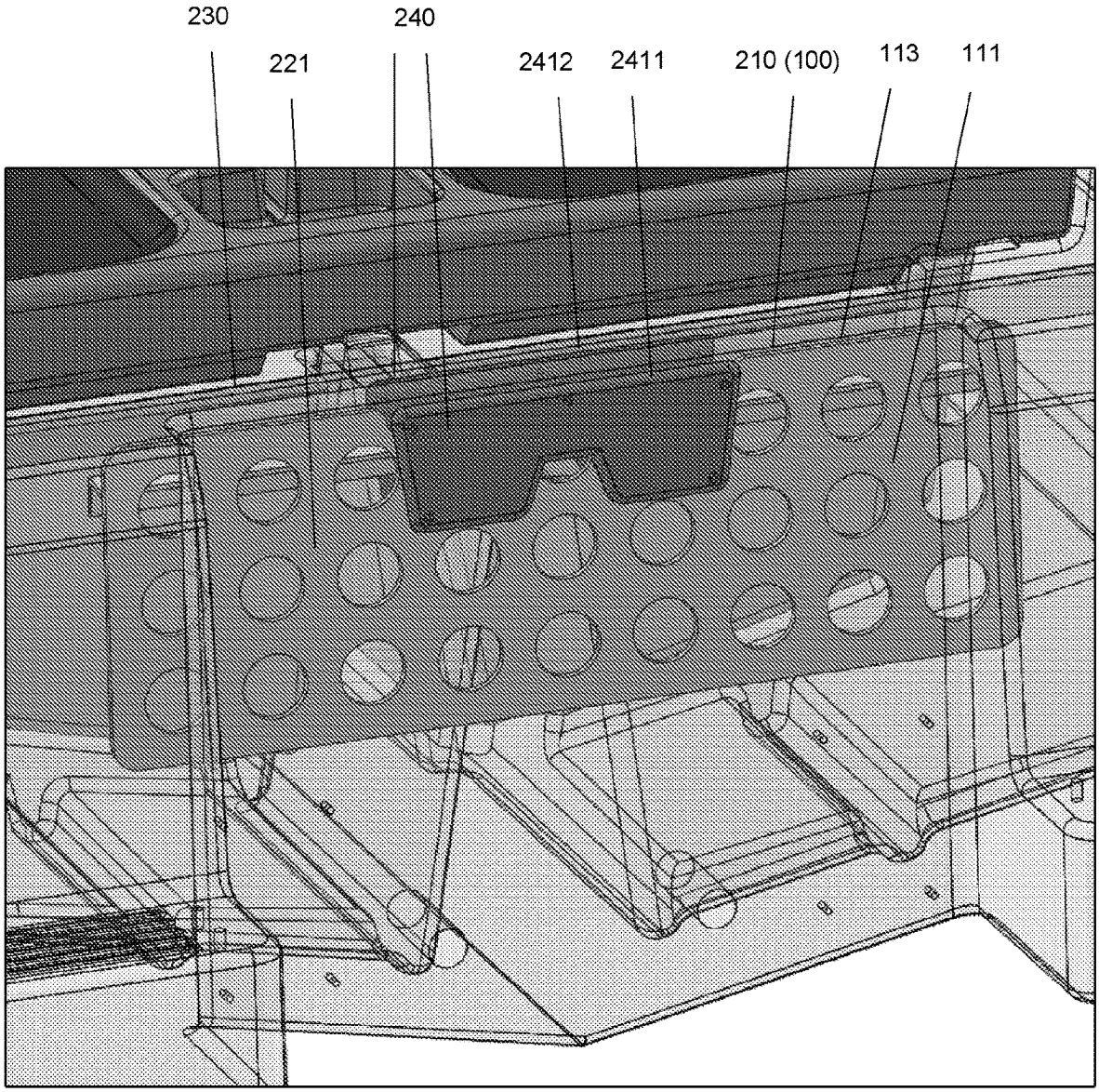
FIG. 5 sets a rear perspective view of the reinforced transom of FIG. 4. For illustrative purposes, the position of an interior support within the reinforced transom is shown by translucent rendering of exterior walls of the reinforced transom.

FIGS. 1 and 2 illustrate a support, support 100, for inclusion internally within a plastic boat body. Support 100 is particularly adapted for inclusion internally within a transom of a plastic boat body, as depicted in FIGS. 3-5.

Support 100 comprises support body 101. Support body 101 comprises support plate 110; and support brace 120.

Support plate 110 of support body 101 is a substantially rectangular support plate, comprising first support plate face 111; second support plate face 112; first longer edge 113; second longer edge 114; first shorter edge 115; and second shorter edge 116. First longer edge 113 of support plate 110 comprises central indented section 1131 located between respective outer sections 1132.

A plurality of substantially circular structural apertures 117 extend through support plate 110 from first support plate face 111 to second support plate face 112. More specifically, support plate 100 comprises twenty-seven structural apertures 117, in a three by nine arrangement.

Support plate 110 further comprises a plurality of substantially circular connection apertures 118. More specifically, support plate 110 comprises four connection apertures 118, with two larger connection apertures 118A flanking two smaller connection apertures 118B.

Support brace 120 of support body 101 is an elongated bracket comprising first support brace portion 121; and second support brace portion 122. Each of first support brace portion 121 and second support brace portion 122 is substantially rectangular. Respective edges of first support brace portion 121 and second support brace portion 122 are rigidly joined.

Support brace 120 is rigidly joined with first support plate face 111 by an edge of first support brace portion 121. First support brace portion 121 of support brace 120 extends substantially perpendicularly to support plate 110. Second support brace portion 122 extends substantially parallel to support plate 110.

Support body 101 comprises aluminium. More specifically, support plate 110 and support brace 120 are formed from marine grade aluminium alloy. Typically, the marine grade aluminium alloy is selected from 5083, 5052, and 5051 aluminium alloy. As depicted, the thickness of aluminium alloy of support plate 110 is 6 mm; and the thickness of the aluminium alloy for support brace 120 is 4 mm.

FIGS. 4 and 5 illustrate reinforced component 200, for incorporation as part of a plastic boat body. More specifically, reinforced component 200 forms part of a transom of a plastic boat body.

Reinforced component 200 comprises interior support 210; exterior walls 220; bridging portion 230; and reinforced component guards 240.

Interior support 210 of reinforced component 200 is in the form of support 100, hereinabove described.

Exterior walls 220 of reinforced component 200 comprise first exterior wall 221; and second exterior wall 222. First exterior wall 221 is of an outer transom wall to be positioned away from interior space of a boat. Second exterior wall 222 is of an inner transom wall to be positioned towards interior space of a boat. First exterior wall 221 and second exterior wall 222 are joined by bridging portion 230.

Exterior walls 220 and bridging portion 230 of reinforced component 200 are formed from plastic. More specifically, exterior walls 220 and bridging portion 230 are formed from marine grade polyethylene. Typically, the marine grade polyethylene is linear low-density polyethylene (LLDPE) or high-density polyethylene (HDPE).

Reinforced component guards 240 of reinforced component 200 comprise first reinforced component guard 241; and second reinforced component guard 242. Reinforced component guards 240 are substantially U-shaped plates, comprising respective longer edges 2411 and 2412. Reinforced component guards 240 are typically formed from marine grade polypropylene. However, the material used for reinforced component guards 240 can be varied as desired. By way of non-limiting example, other plastic materials such as polyethylene or nylon, and metallic materials such as aluminium, may also be suitable.

Interior support 210, in the form of support 100, is located internally within reinforced component 200, bordered by exterior walls 220 and bridging portion 230. First support plate face 111 of support 100 is positioned adjacent first exterior wall 221; second support brace portion 122 of support 100 is positioned adjacent second exterior wall 222; and first longer edge 113 of support 100 is positioned adjacent bridging portion 230.

Reinforced component guards 240 are attached externally to exterior walls 220 of reinforced component 200, such as by screws and/or chemical adhesive or the like. First reinforced component guard 241 is attached externally to first exterior wall 221; and second reinforced component guard 242 is attached externally to second exterior wall 222. Respective longer edges 2411 and 2412 of reinforced component guards 241 and 242 are substantially aligned with outer sections 1132 of first longer edge 113 of support plate 110 and extend substantially across regions corresponding to central indented section 1131 of support plate 110.

FIGS. 6-21 illustrate a plastic boat body, boat body 50. Boat body 50 has a general form that may be described, in non-limiting terms, as that of a dinghy, or dinghy-like. Boat body 50 comprises stern 51; bow 52; and hull 53.

Stern 51 of boat body 50 comprises transom 511; legs 512; and stern brace 513.

Figure 14:
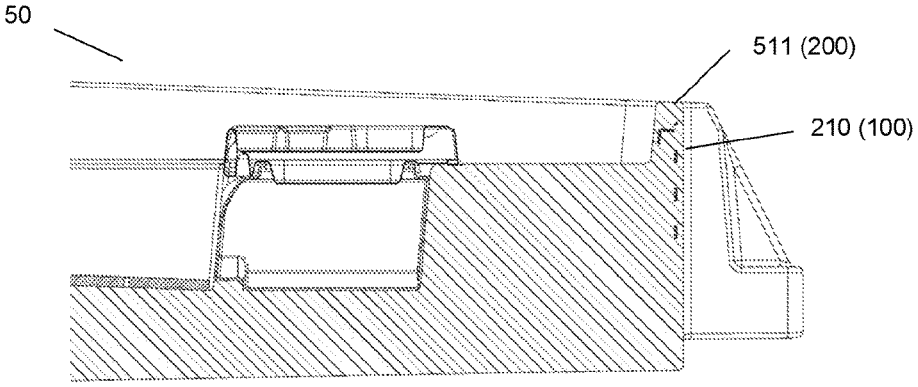
FIG. 14 sets forth a partial longitudinal section of a rear portion of the boat body of FIG. 6, showing the position of a support within the transom of the boat body. Regions that may be filled with foam for buoyancy are shown with diagonal lines.
Figure 15:
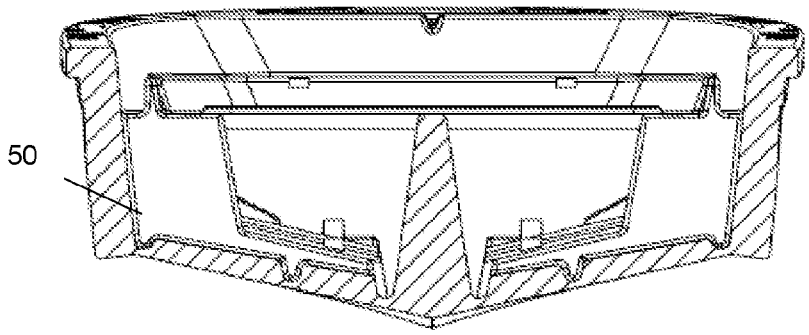
FIG. 15 sets forth a transverse section near to the rear of the boat body of FIG. 6. Regions that may be filled with foam for buoyancy are shown with diagonal lines.
Figure 16:
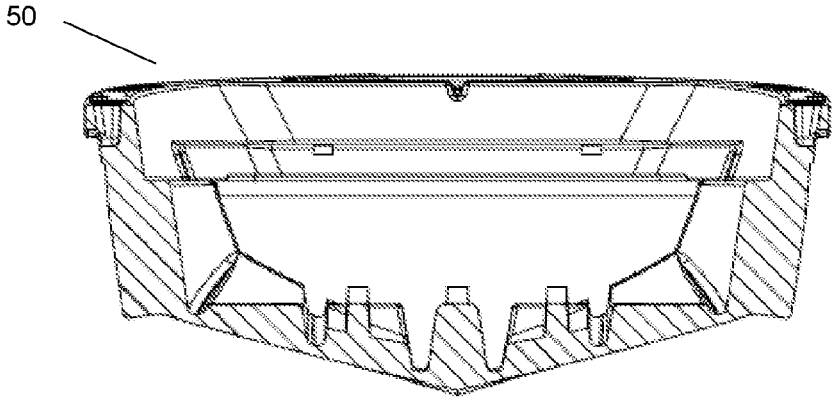
FIG. 16 sets forth a transverse section towards the front of the boat body of FIG. 6, relative to the section position as per FIG. 15. Regions that may be filled with foam for buoyancy are shown with diagonal lines.
Figure 17:
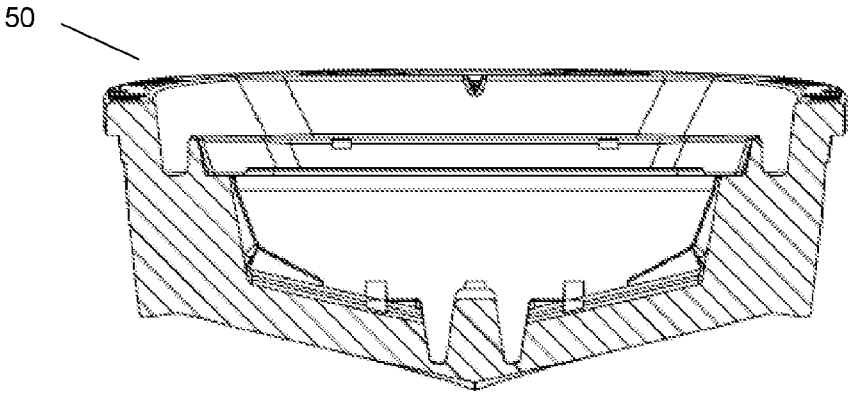
FIG. 17 sets forth a transverse section towards the front of the boat body of FIG. 6, relative to the section position as per FIG. 16. Regions that may be filled with foam for buoyancy are shown with diagonal lines.
Figure 18:
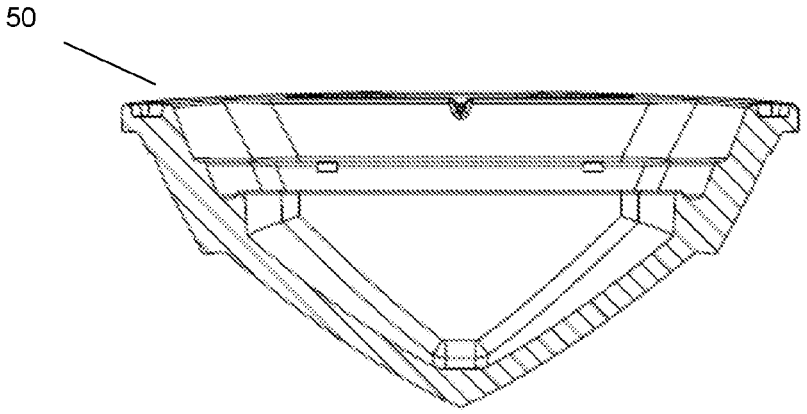
FIG. 18 sets forth a transverse section towards the front of the boat body of FIG. 6, relative to the section position as per FIG. 17. Regions that may be filled with foam for buoyancy are shown with diagonal lines.
Figure 19:
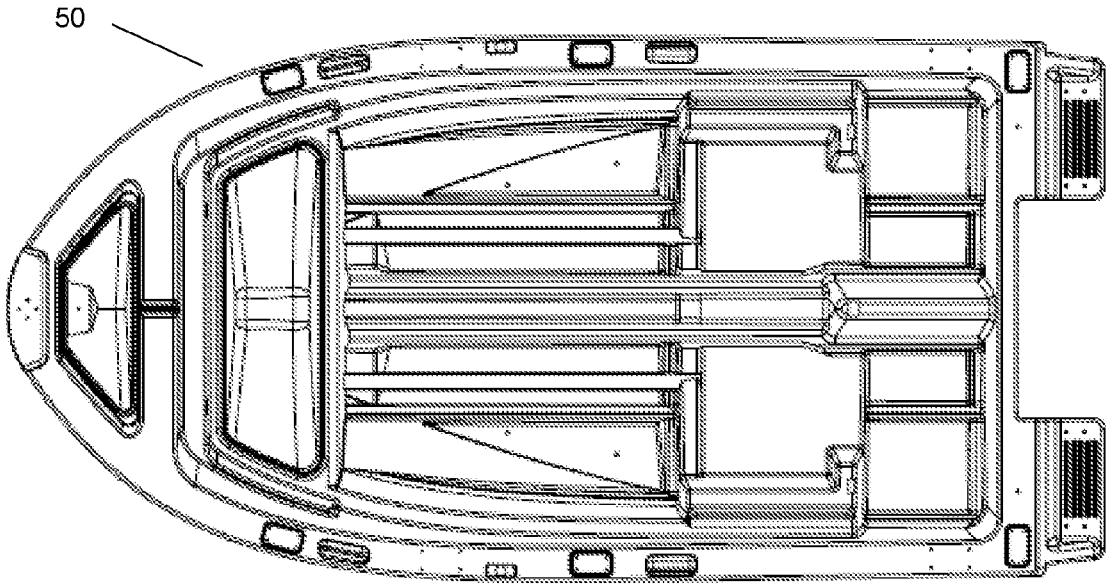
FIG. 19 sets forth a top view of the boat body of FIG. 6, with removable components removed.

Transom 511 of stern 51 comprises reinforced component 200 hereinabove described (reinforced component guards 240 not shown). The position of interior support 210 (in the form of support 100) of reinforced component 200 within transom 511 of boat body 50 is shown in FIG. 14. Transom 511 further comprises drainage ports 5111, best seen in FIGS. 7 and 11.

Figure 7:
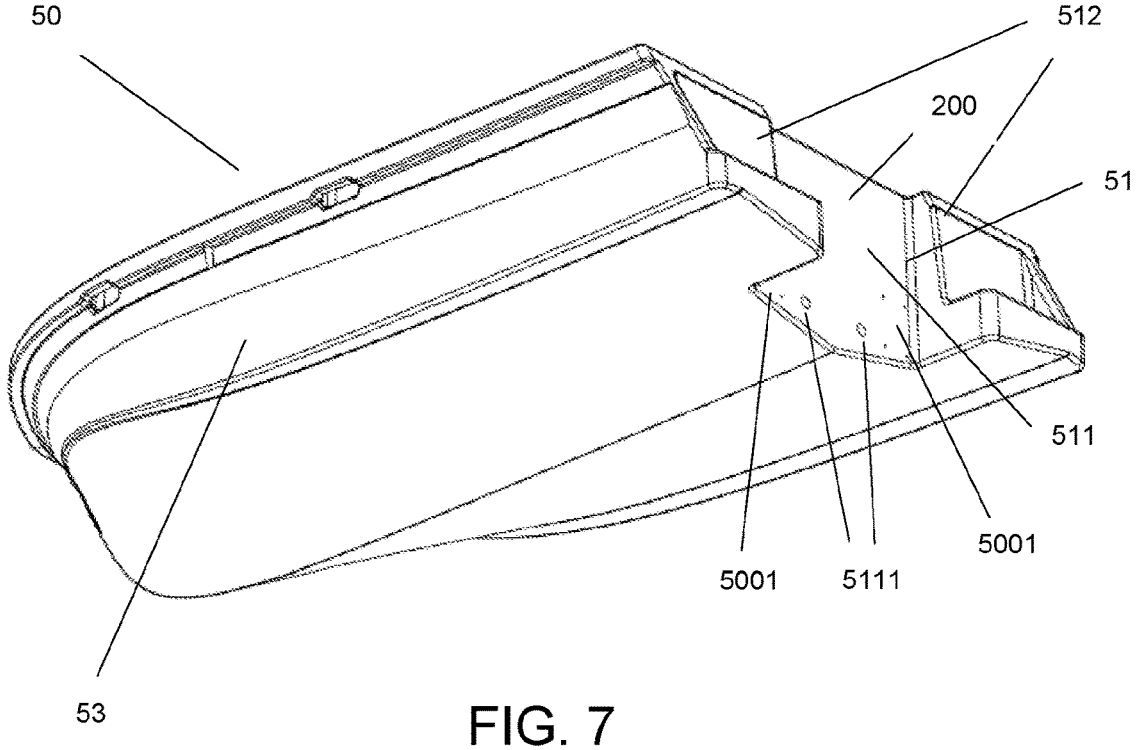
Figure 8:
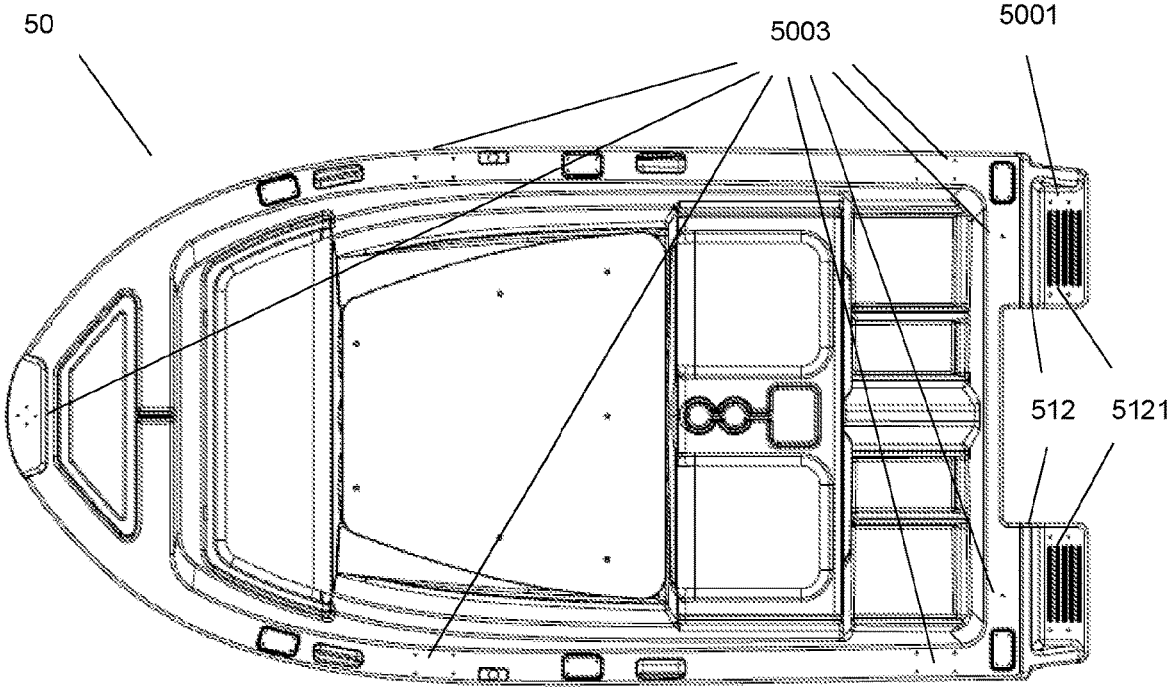
FIG. 8 sets forth a top view of the boat body of FIG. 6.

As best seen in FIG. 8, legs 512 of stern 51 comprise foot portions 5121. As best seen in FIG. 7, legs 512 flank transom 511, projecting outwards therefrom.

Figure 6:
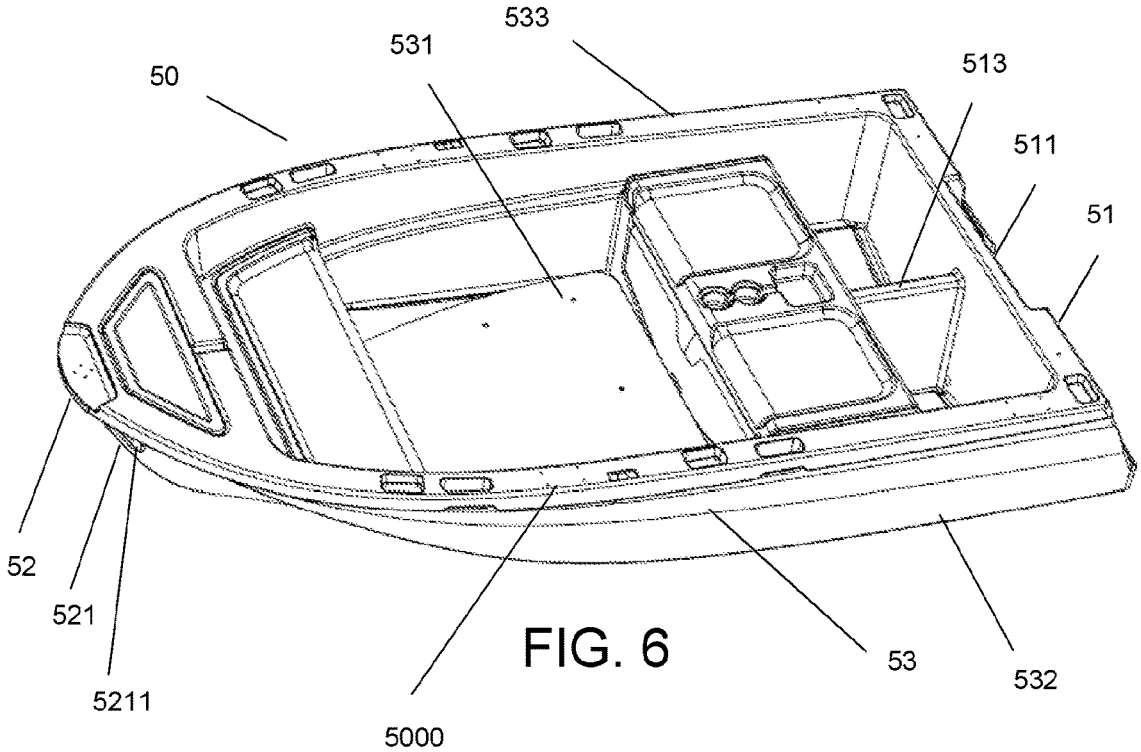
FIG. 6 sets forth an upper perspective view of an embodiment of a boat body, according to an aspect of the invention FIG. 7 sets forth a lower perspective view of the boat body of FIG. 6.

As best seen in FIG. 6, stern brace 513 of stern 51 comprises walls extending substantially perpendicularly from an interior face of stern 51. Stern brace 513 extends substantially along a central longitudinal axis of boat body 50.

Figure 12:
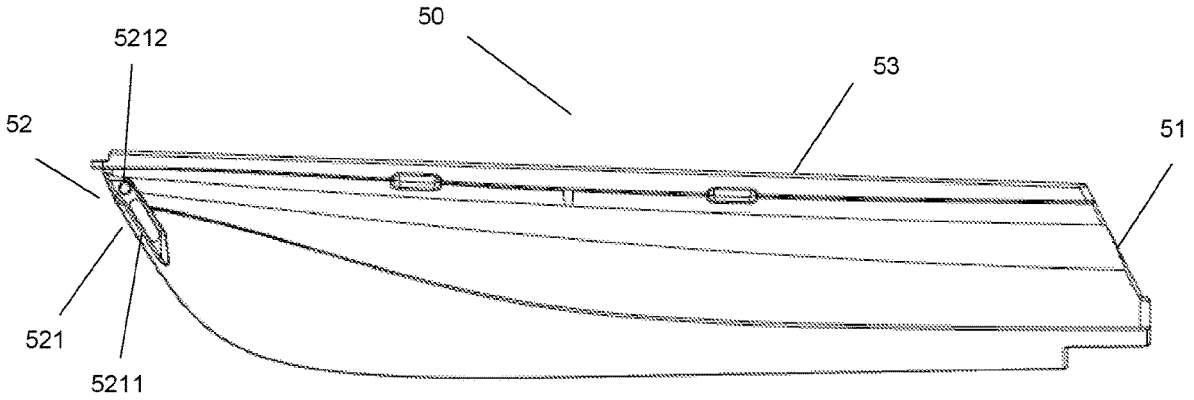
FIG. 12 sets forth a side view of the boat body of FIG. 6.
Figure 13:
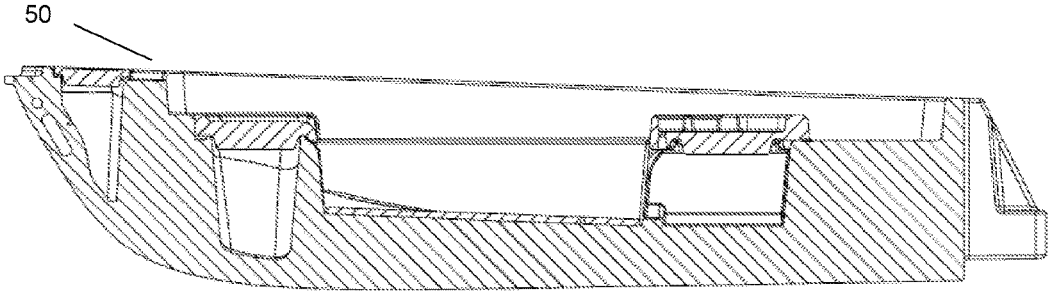
FIG. 13 sets forth a longitudinal section of the boat body of FIG. 6. Regions that may be filled with foam for buoyancy are shown with diagonal lines.

As best seen in FIG. 12, bow 52 of boat body 50 comprises handle 521. Handle 521 comprises grip aperture 5211 having a flattened oval shape; and tie aperture 5212 having a substantially circular shape. Handle 521 is integrally formed within bow 52.

As best seen in FIGS. 6 and 7, hull 53 of boat body 50 comprises interior space 531; boat bottom 532; and gunwale 533.

Boat body 50 further comprises a plurality of attachment components 5000. Attachment components 5000 comprise metallic threaded inserts moulded within boat body 50, typically M6 (M6×1) or M8 (M8×1 or M8×1.25) threaded inserts. Typically, threaded inserts of attachment components 5000 comprise brass or stainless steel.

Figure 11:
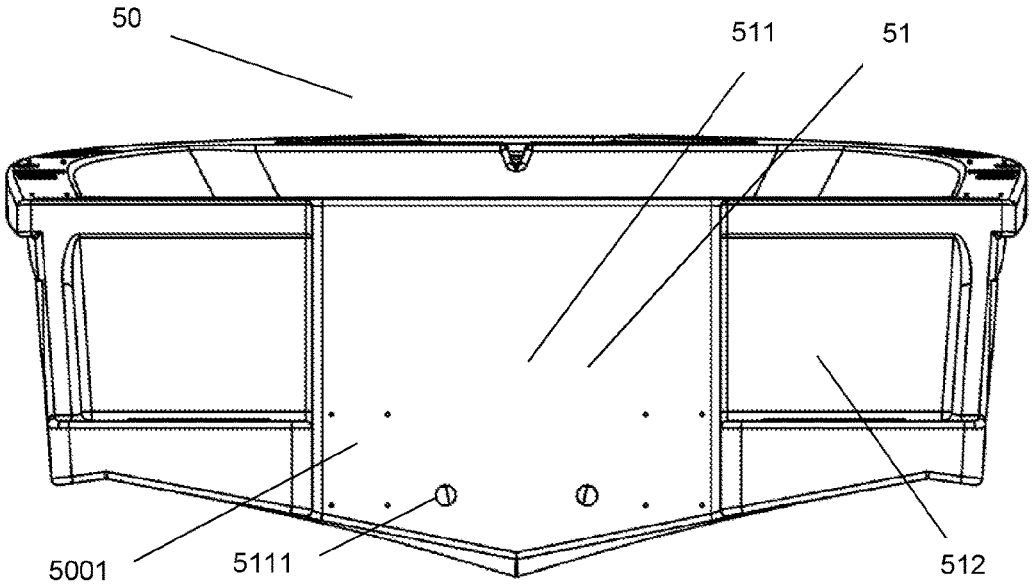
FIG. 11 sets forth a rear view of the boat body of FIG. 6.

Attachment components 5000 of boat body 50 include stern attachment components 5001, best seen in FIGS. 8 and 11; and gunwale attachment components 5003, best seen in FIGS. 6 and 8.

Figure 20:
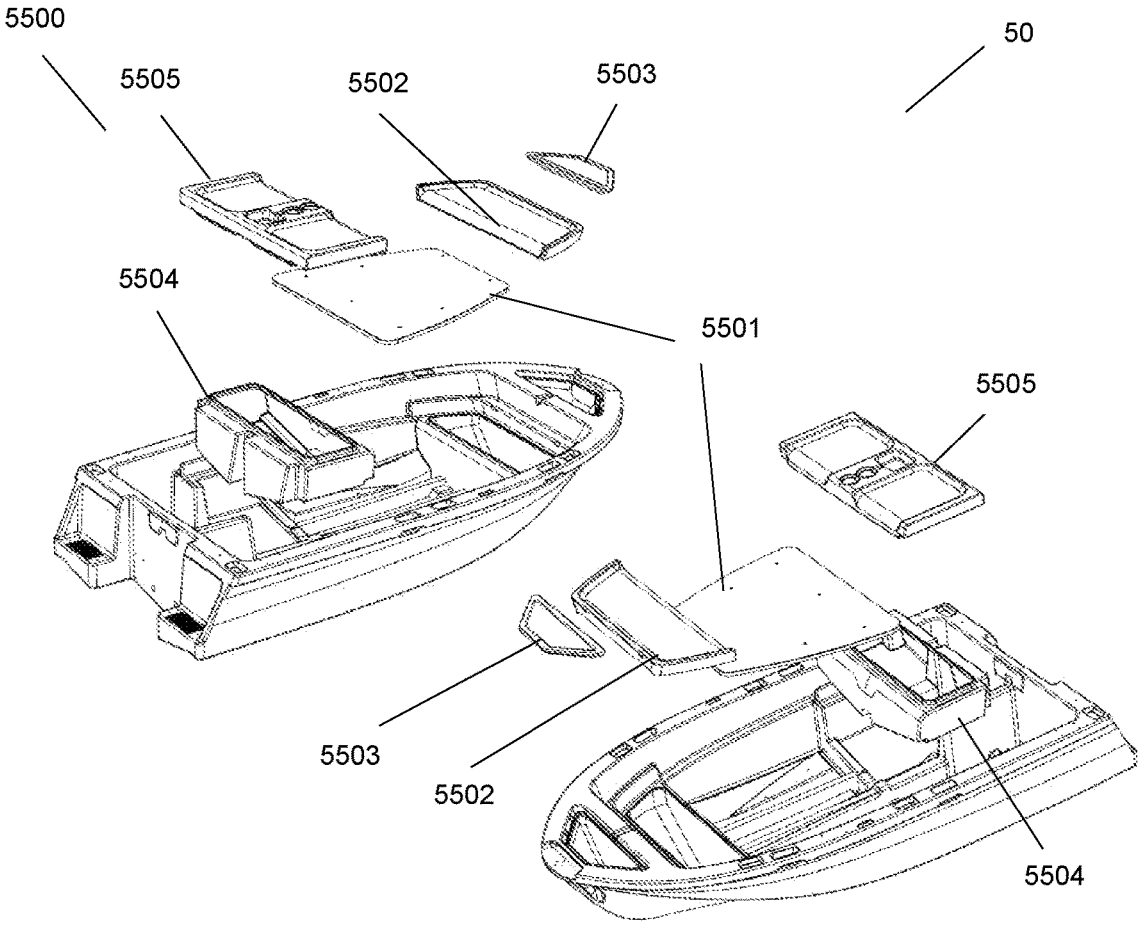
FIG. 20 sets forth front and rear exploded views of the boat body of FIG. 6.

As best seen in FIG. 20, boat body 50 further comprises a plurality of removable components 5500. Removable components 5500 include removable deck cover 5501; removable bench cover 5502; removable bow cover 5503; removable seat base 5504; and removable seat cover 5505.

Boat body 50 typically comprises a foam-filled double skin structure, such foam-filled double skinned structures being known, in general terms, in the art. Regions wherein foam is typically placed within boat body 50 are indicated with diagonal lines in FIGS. 13-18.

Typically, skins of boat body 50 are formed from marine grade polyethylene. Typically, the marine grade polyethylene is LLDPE and/or HDPE. Typically, foam of foam-filled boat body 50 is foamed plastic, such as polyethylene foam or polyurethane foam, although without limitation thereto.

Figure 9:
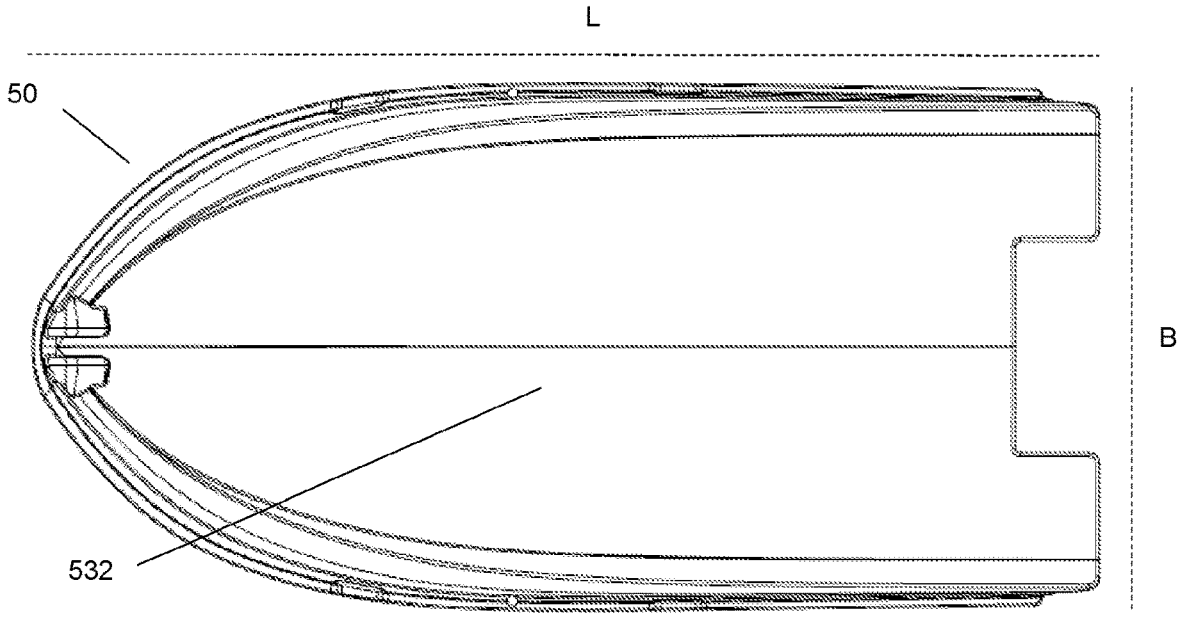
FIG. 9 sets forth a bottom view of the boat body of FIG. 6. Length (L) and breadth (B) dimensions of the boat body are shown with dashed lines.
Figure 10:
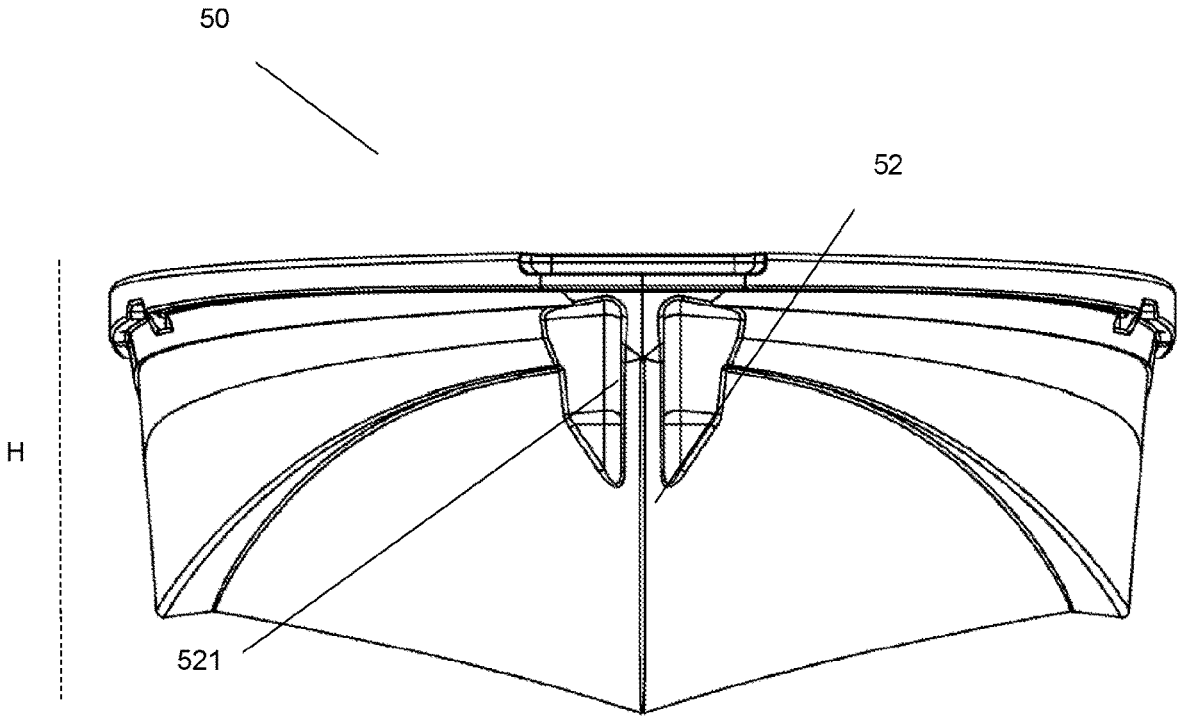
FIG. 10 sets forth a front view of the boat body of FIG. 6. A height (H) dimension of the boat body is shown with a dashed line.

In one typical embodiment, which may be referred to herein as the '3 m embodiment', boat body 50 has parameters, best seen in FIGS. 9 and 10, as follows: length (L) ~3 m; breadth (B) ~1.5 m; height (H) ~0.6 m. For the 3 m embodiment, typical parameters, best seen in FIG. 2, of support 100 are as follows: breadth (b) ~0.3 m; height (h) ~0.1 m.

Various advantages of, and alternatives to, typical embodiments of aspects of the invention will now be described, by way of non-limiting example.

Generally, support 100, and reinforced component 200 comprising support 100, are considered advantageous for strengthening and/or stabilising a plastic boat body.

The construction of support 100 from aluminium or aluminium alloy is considered particularly advantageous in the context of strengthening and stabilising plastic boat bodies. Aluminium and alloys thereof typically offer properties that are desirable in the context of the invention, for example, in respect of resilience and strength to weight ratio. Aluminium of a thickness of between about 3 mm and about 9 mm, including about 4, 5, 6, 7, and 8 mm, is considered particularly desirable for forming support plate 110 and/or support brace 120 of support 100 as described herein.

However, it will be appreciated that support 100 need not necessarily be formed from aluminium or an aluminium alloy. In alternative embodiments, support 100 may be formed using other materials, inclusive of other metals, such as stainless steel; reinforced plastics, such as fibreglass and carbon fibre reinforced plastics; and synthetic fibre materials such as aramids, e.g. Kevlar and Technora.

The skilled person will appreciate that the transom of a boat is a key structural area that is subject to substantial force from water in use. Furthermore, the transom is a typical point of attachment for boat motors, and force applied to the transom when a plastic boat is powered by attachment of a motor thereto is increased very significantly. For durability, the transom of a plastic boat to which a motor is to be attached should be capable of resilient flexing under strong force over large numbers of cycles (e.g. thousands of flexing cycles) during the life of the plastic boat.

Advantageously, support 100 and reinforced component 200 are particularly adapted for inclusion as part of a transom of a plastic boat body. Support 100 and reinforced component 200 are particularly well-adapted to facilitate durable resilient flexing of plastic boat bodies, such as boat body 50, including flexing of a transom when powered by a motor attached to the transom.

Figure 21:
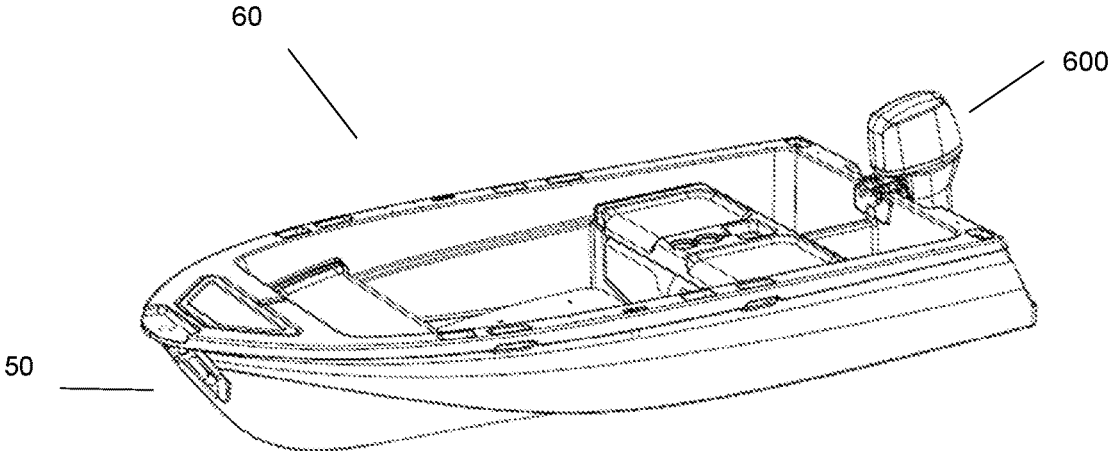
FIG. 21 sets forth a front perspective view of the boat body of FIG. 6 fitted with a boat motor.

One embodiment of a system according to an aspect of the invention, system 60, comprising a plastic boat body fitted with a boat motor, is depicted in FIG. 21. System 60 comprises boat body 50 fitted with boat motor 600, which may be of a capacity of up to about 200 horsepower (hp), as discussed further hereinbelow. Advantageously, use of reinforced component 200 comprising support 100 as part of boat body 50 may facilitate use of a larger capacity boat motor with boat body 50 as per system 60, as compared to a typical plastic boat body.

Although shape and configuration of support 100 and reinforced component 200 are adapted to form part of transom 511 of boat body 50, it will be appreciated that inserts and reinforced components according to aspects of the invention can be readily modified to suit various transom and/or stern shapes or designs. That is, although plastic boat 50 is considered particularly well-adapted to be enhanced by inclusion of support 100 and/or reinforced component 200, support 100 and/or reinforced component 200, or modifications thereof, can be used with plastic boats other than plastic boat 50.

It will be further appreciated that, in alternative embodiments, supports and reinforced components according to aspects of the present invention may be adapted for use in other areas of plastic boat bodies. By way of non-limiting example, supports and reinforced components could be adapted to provide strength and/or stability to the bow of a plastic boat body, such as bow 52 of boat body 50.

As described herein, support 100 is adapted for internal inclusion within reinforced component 200. Inclusion of support 100 entirely internally within reinforced component 200 is considered advantageous in the context of aspects of the current invention. By way of non-limiting example, internal inclusion of support 100 may be advantageous for structural integrity of reinforced components comprising support 100, and/or for enhancing the ability of support 100 and exterior walls 220 to resiliently flex as a unit.

Another advantage of internal inclusion of support 100 within reinforced component 200 is that this arrangement can prevent, or at least constrain, exposure of support 100 from elements which may lead to degradation of support 100 in use. For example, internal inclusion of support 100 within reinforced component 200 can prevent or constrain exposure of support 100 to water, air, excess heat, and/or mechanical stress by direct contact.

However, it will be appreciated that, in alternative embodiments, part of a support as described herein may be located outside of a reinforced component as described herein. By way of non-limiting example, a support may include an internal portion within the transom, and an external portion extending over part of an external wall of the transom.

The arrangement of plate 110 and brace 120 within support 100 is considered particularly advantageous for optimal reinforcement of a transom of a plastic boat body. In one alternative embodiment (not shown), brace 120 or a further component of support 100 may extend into a stern brace of a plastic boat body, such as stern brace 513 of boat body 50.

In another alternative embodiments of support 100, brace 120 may be excluded; and/or one or more braces, such as vertical braces, e.g. extending between first longer edge 113 and second longer edge 114 of support 100, may be included.

The arrangement of structural apertures 117 of support 100 is considered advantageous to increase resilient flexing capacity and/or strength to weight ratio of support 100. In particular, use of substantially evenly spaced apertures occupying at least 20%, such as at least: 25%, 30%, 35%, 40%, 45%, 50%, 55%, 60%, and 65%, of an area defined by a face (e.g. first support plate face 111) of a support as described herein is considered particularly advantageous.

However, it will be understood that size, number, and/or position of structural apertures 117 may be varied. In some alternative embodiments, structural apertures 117 may be excluded.

Connection apertures 118 are considered advantageous to allow for stable positioning of support 100 within reinforced component 200 during moulding. By way of elaboration, internal projections (not shown) from exterior walls (such as exterior wall 221 and/or exterior wall 222) can be placed through connection apertures (such as connection apertures 118A and/or 118B) to hold support 100 in place during moulding to form reinforced component 200.

However, it will be understood that the size, number, and/or position of connection apertures 118 may be varied. In some alternative embodiments, connection apertures 118 may be excluded.

As depicted, surfaces of support 100, including surfaces of support plate 110 and support brace 120, are substantially smooth. In alternative embodiments, at least some surfaces of supports as described herein, such as support 100, may be roughened. Roughened support surface may be desirable for holding the support in place during and/or after moulding into a reinforced component, such as reinforced component 200.

Use of LLDPE and/or HDPE to form boat body 50 as herein described is considered advantageous in the context of the current invention. Physical properties of LLDPE and HDPE, e.g. resilience, durability, and flexibility, are considered well-suited to enhancement by inclusion of support 100 and/or reinforced component 200.

However, in alternative embodiments, other plastics may be suitable. By of non-limiting example, polyolefins more generally, such as polyethylene varieties other than LLDPE and HDPE, and polypropylene varieties inclusive of homopolymer, random copolymer and block copolymer polypropylene varieties, may have suitable properties for use to form boat body 50.

It will be further appreciated that, plastic boat bodies as described herein, such as boat body 50, may include minor amounts of non-plastic material. In embodiments, plastic boat bodies as described herein include less than 20% non-plastic materials, including 19%, 18%, 17%, 16%, 15%, 14%, 13%, 12%, 11%, 10%, 9%, 8%, 7%, 6%, 5%, 4%, 3%, 2%, and 1% or less non-plastic materials.

Although not typical, some alternative embodiments of boat body 50 may be formed primarily from non-plastic materials.

Shape and configuration properties of boat body 50 as described herein are also considered advantageous to facilitate enhancement (e.g. in respect of strength and/or resilient flexing properties) by inclusion of support 100 and/or reinforced component 200.

For example, the shape and configuration of stern 51, wherein transom 511 comprising reinforced component 200 is bordered by legs 512, is considered advantageous for providing particularly desirable strength and rigidity when reinforced component 200 is present. Legs 512 are typically formed from solid plastic, and the bulk of solid plastic of legs 512 may assist in this respect.

Inclusion of stern brace 513 of boat body 50 is also considered advantageous for providing particularly desirable strength and rigidity when reinforced component 200 is present.

However, it will be appreciated that supports and reinforced components as described herein are general applicable (with suitable modification, as appropriate) to a variety of plastic boat bodies.

As set out hereinabove, an embodiment of boat body 50, which may be referred to as the 3 m embodiment, has parameters of length ~3 m; breadth ~1.5 m; height ~0.6 m. More generally, it will be understood that boat body 50 has a ratio of length (L):breadth (B):to height (H) of about 10:5:2.

It will be appreciated that other embodiments of boat body 50 may, although need not necessarily, have approximately the same L:B:H ratio, on different scales. By way of non-limiting example, a 2.5 m embodiment of boat body 50 may have L:B:H of ~2.5 m:~1.25 m:~0.5 m; a 4 m embodiment of boat body 50 may have L:B:H of ~4 m:~2 m:~0.8 m; a 5 m embodiment of boat body 50 may have L:B:H of ~5 m:~2.5 m:~1 m; and a 7 m embodiment of boat body 50 may have L:B:H of ~7 m:~3.5 m:~1.4 m.

Generally, larger scale embodiments of boat body 50 will be suitable for use with larger size boat motors, e.g. as per system 60. By way of elaboration, it is considered that 2.5 m embodiments of boat body 50 are particularly well-suited to use with boat motors of up to about 10 horsepower (hp) or 50 kilograms (kg); 3 m embodiments of boat body 50 are particularly well-suited to use with boat motors of up to about 15 hp or 75 kg; 4 m embodiments of boat body 50 are particularly well-suited to use with boat motors of up to about 50 hp or 150 kg; and 7 m embodiments of boat body 50 are particularly well-suited to use with boat motors of up to about 200 hp or 300 kg.

As set out hereinabove, for 3 m embodiments of boat body 50, typical parameters of support 100 are as follows: breadth ~0.3 m; height ~0.1 m. It will be understood that boat body 50 comprising support 100 has a ratio of boat body breadth (B):support breadth (b) of about 3:1; and a ratio of boat body height (H):support height (h) of about 6:1.

More generally, it is considered advantageous for embodiments of boat body 50 to have ratios of boat body breadth (B):support breadth (b) of between about 1.5:1 to about 6:1, including about: 2:1, 3:1, 4:1, and 5:1. Additionally, it is considered advantageous for embodiments of boat body 50 to have ratios of boat body height (H):support height (h) of about 3:1 to about 12:1, including about 4:1, 5:1, 6:1; 7:1, 8:1, 9:1, and 10:1.

Inclusion of integrally formed handle 521 in bow 52 of boat body 50 is considered particularly advantageous in the context of the current invention. It will be appreciated that placement of a handle at the bow of a plastic boat body allows for relatively efficient movement of the boat body by pulling by a user.

Side handles are used in some plastic boats, which can be effective for lifting a plastic boat. However, for plastic boats such as comprising boat body 50 fitted with a relatively substantial motor, side handles are typically ineffective. In contrast, an integrally formed handle, such as handle 521 can allow for effective pulling of a boat body with a motor attached, such as per system 60 described herein.

As noted above, the inclusion of reinforced component 200 as part of boat body 50 allows for use of a relatively heavy motor with boat body 50, such as per system 60. The strength, e.g. as compared to an attached handle, and placement of integrally formed handle 521 is considered particularly advantageous for pulling of system 60, such as from shallows onto beach. This can be particularly the case if wheels, such as transom dinghy wheels, are attached to boat body 50 of system 60.

The arrangement of handle 521 comprising grip aperture 5211 and tie aperture 5212 is also considered particularly desirable. Grip aperture 5211 is particularly adapted for gripping by a user, such as when pulling boat body 50 and/or system 60. Tie aperture 5211 is particularly adapted for tie-off of boat body 50 and/or system 60, such as using rope or a metal shackle.

It will be appreciated, however, that the particular arrangement of integrally formed handle 521 can be varied as desired.

Attachment components 5000 of boat body 50 are also considered particularly advantageous in the context of aspects of the current invention. Incorporation of a plurality of moulded threaded inserts within the stern (e.g. attachment components 5001) and gunwale (e.g. attachment components 5003) of a plastic boat as described herein allows for efficient connection of a range of accessories, without the need for modification (such as cutting) of boat body 50, as is often required for plastic boats.

Attachments component in the form of a plurality of moulded threaded inserts 5000 can also offer advantages in respect of strength for attachment. This may be particularly advantageous in the context of aspects of the current invention. By way of non-limiting example, use of a davit may be desirable for lifting of boat bodies and systems as described herein, particularly boat bodies fitted with relatively heavy boat motors, such as system 60. The arrangement of attachment components 5000 as described herein, including attachment components 5003 at various locations across gunwale 533, is considered particularly advantageous for connection of a davit to lift boat bodies and systems as described herein.

The inclusion of stern attachment components 5001 for boat body 50 is also considered advantageous. For example, the strength of moulded inserts 5001 provide for durable connection of wheels to boat body 50, such as transom dinghy wheels and the like, as are known in the art. Use of transom dinghy wheels connected to moulded inserts 5001 can be particularly advantageous when pulling a system such as system 60 herein described, wherein boat body 50 is fitted with a relatively heavy boat motor 600.

As set out hereinabove, attachment components 5000 typically comprise metallic M6 or M8 threaded inserts. The use of metallic inserts, such as stainless steel or brass, is considered advantageous for strength and/or durability. Additionally, M6 or M8 threading is considered desirable as this threading type is commonly in use for accessories suitable for attachment to boat body 50, such as transom dinghy wheels.

However, it will be appreciated that other materials and/or thread parameters can be used for attachment components 5000, as desired. By way of non-limiting example, in alternative embodiments, threading formed from other metals, such as aluminium; plastic, such as polyethylene or polypropylene (including by direct moulding of boat body 50; reinforced plastic, such as fibreglass and carbon fibre reinforced plastics; and synthetic fibre materials such as aramids, e.g. Kevlar and Technora, may be suitable. A range of thread parameters including both metric and imperial thread sizes, may also be suitable.

Figure 22:
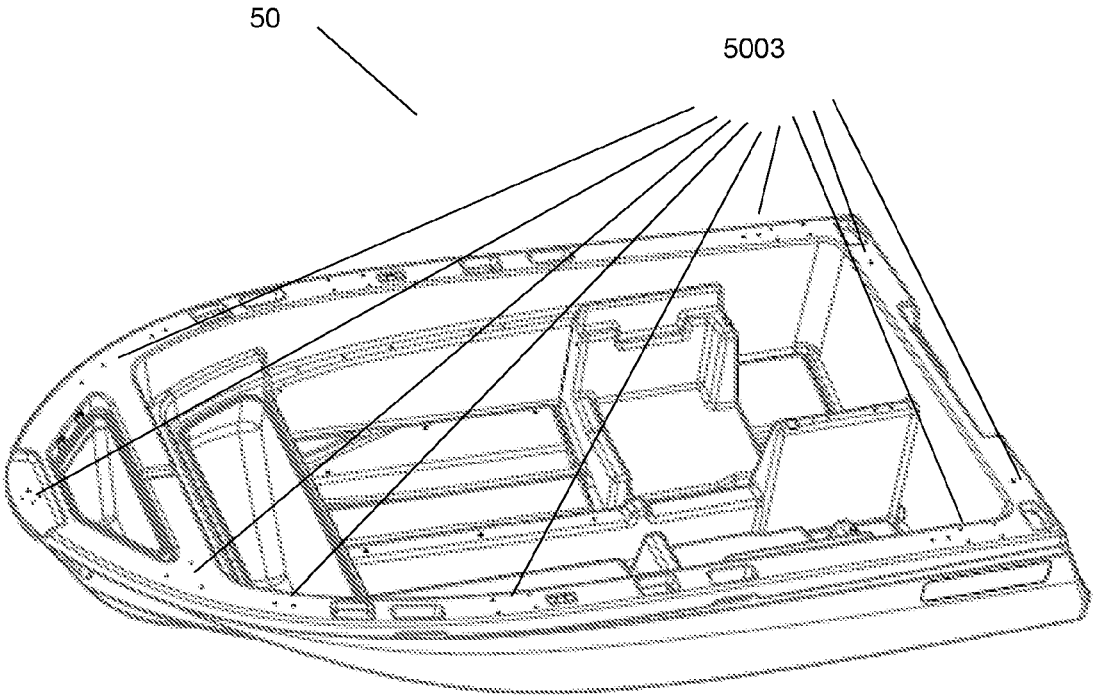
FIG. 22 sets forth a side perspective view of another embodiment of a boat body according to an aspect of the invention, with removable components removed.
Figure 23:
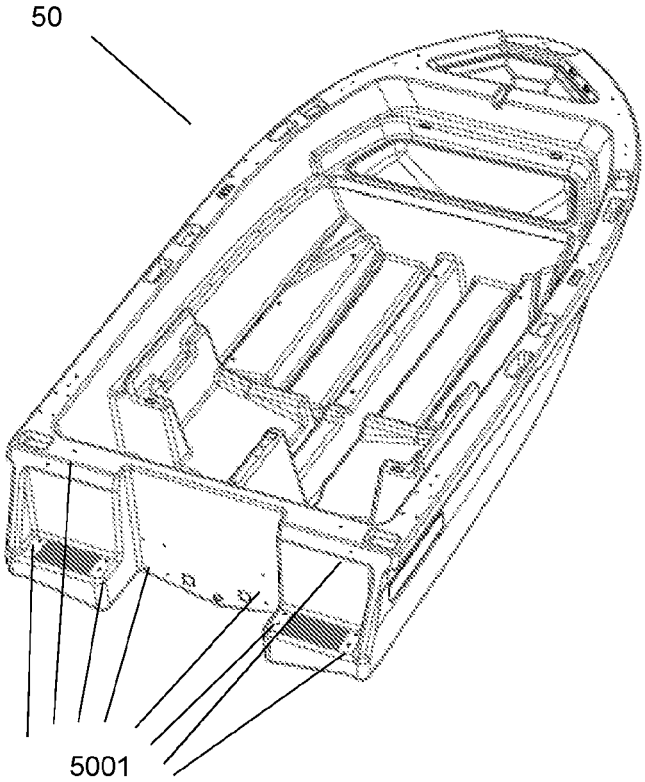
FIG. 23 sets forth a rear perspective view of the boat body of FIG. 22.

It will also be readily appreciated that the number and location of attachment components within boat bodies, such as boat body 50, can be varied. By way of example, FIGS. 22 and 23 set out a further embodiment of boat body 50, wherein additional attachment components 5000, including gunwale attachment components 5003 and stern attachment components 5001, and further attachment components on the floor, lateral rails, and stern brace, are incorporated, relative to the embodiment of boat body 50 illustrated in FIGS. 6-21.

Removable components 5500 can also have advantages in the context of the invention. For example, due to the ability of systems as described herein, such as system 60, to include comparatively powerful boat motors, the systems may have increased capacity for carriage of material within the plastic boat body forming part of the system, as compared to existing plastic boat body and boat motor arrangements. The arrangement of removable components such as removable components 5500 can allow for substantial additional storage space within plastic boat bodies, such as boat body 50.

It will be understood generally that the above description of embodiments of the invention is provided for purposes of description to one of ordinary skill in the related art. It is not intended to be exhaustive or to limit the invention to a single disclosed embodiment. In some instances, well-known components and/or processes have not been described in detail, so as not to obscure the embodiments described herein.

As described, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations that have been discussed herein, and other embodiments that fall within the spirit and scope of the invention.

In this specification, the indefinite articles "a" and "an" are not to be read as singular indefinite articles or as otherwise excluding more than one or more than a single subject to which the indefinite article refers. For example, "a" support includes one support, one or more supports, and a plurality of supports.

In this specification, the terms "comprises", "comprising", "includes", "including", and similar terms are intended to mean a non-exclusive inclusion, such that an apparatus, system, or method that comprises or includes a list of elements need not have those elements solely, and may well have other elements not listed.

In this specification, the terms "consisting essentially of" and "consists essentially of" are intended to mean a non-exclusive inclusion only to the extent that, if additional elements are included beyond those elements recited, the additional elements do not materially alter basic and novel characteristics. That is, an apparatus, system, or method that "consists essentially of" one or more recited elements includes those elements only, or those elements and any additional elements that do not materially alter the basic and novel characteristics of the apparatus, system, or method.

In this specification, terms such as "above" and "below"; "front" and "back"; "top" and "bottom"; "left" and "right"; "horizontal" and "vertical", and the like, may be used for descriptive purposes. However, it will be understood that embodiments can potentially be arranged in various orientations, and that such relative terms are not limiting and may be interchangeable in appropriate circumstances.

In this specification, unless the context requires otherwise, the terms "connection", "connected", "connecting", and the like, are not to be read as limited to direct connections and may also include indirect connections. For example, unless the context requires otherwise, a stated first component "connected" to a stated second component may be connected via, through, or by, one or more unstated components.

The invention claimed is:

1. A reinforced, resiliently flexible transom for a double skin, moulded plastic boat body, the reinforced transom comprising:

a first exterior wall formed by plastic moulding;

a second exterior wall formed by plastic moulding;

a metallic support plate positioned between the first exterior wall and the second exterior wall;

a metallic support brace rigidly coupled with the metallic support plate and extending towards the second exterior wall;

a first reinforced component guard coupled with an exterior surface of the first exterior wall; and a second reinforced component guard coupled with an exterior surface of the second exterior wall;

wherein the metallic support brace is positioned between the first reinforced component guard and the second reinforced component guard.

2. The reinforced transom of claim 1, wherein the first exterior wall and the second exterior wall comprise polyethylene, polypropylene, or a combination thereof.

3. The reinforced transom of claim 1, wherein the metallic support plate is adjacent to the first exterior wall; and the metallic support brace is adjacent to the second exterior wall.

4. The reinforced transom of claim 1, wherein the metallic support plate and the metallic support brace comprise aluminium or an aluminium alloy.

5. The reinforced transom of claim 1, wherein the metallic support plate is substantially rectangular.

6. The reinforced transom of claim 5, wherein the metallic support plate comprises a plurality of structural apertures, wherein the plurality of structural apertures occupy at least 20% of a surface area of a face of the metallic support plate.

7. The reinforced transom of claim 5, wherein the metallic support plate comprises a central longitudinally extending indented top edge section disposed between a pair of longitudinally extending outer top edge sections.

8. The reinforced transom of claim 7, wherein the first reinforced component guard comprises a first substantially U-shaped plate defining a first longitudinally extending upper edge, wherein the second reinforced component guard comprises a second substantially U-shaped plate defining a second longitudinally extending upper edge, and wherein the first longitudinally extending upper edge and the second longitudinally extending upper edge are substantially aligned with the pair of longitudinally extending outer top edge sections of the metallic support plate.

9. The reinforced transom of claim 1, wherein the first reinforced component guard and the second reinforced component guard comprise polypropylene.

10. The reinforced transom of claim 1, wherein the first reinforced component guard is adhered to the exterior surface of the first exterior wall and second reinforced component guard is adhered to the exterior surface of the second exterior wall.

11. The reinforced transom of claim 1, wherein the first reinforced component guard is fastened to the exterior surface of the first exterior wall and the second reinforced component guard is fastened to the exterior surface of the second exterior wall.

12. A reinforced, resiliently flexible transom for a double skin, moulded plastic boat body, the reinforced transom comprising:

a first exterior wall formed by plastic moulding;

a second exterior wall formed by plastic moulding;

a metallic support plate positioned between the first exterior wall and the second exterior wall;

a metallic support brace rigidly coupled with the metallic support plate and extending towards the second exterior wall, the metallic support brace comprising a first portion and a second portion, the first portion extending substantially perpendicular from a surface of the metallic support plate towards the second exterior wall and the second portion extending substantially parallel to the metallic support plate from a longitudinally extending edge of the first portion;

wherein the metallic support plate and the metallic support brace are supported between the first exterior wall and the second exterior wall by a plastic foam.

13. The reinforced transom of claim 12, wherein the first exterior wall and the second exterior wall comprise polyethylene, polypropylene, or a combination thereof.

14. The reinforced transom of claim 12, wherein the metallic support plate and the metallic support brace comprise aluminium or an aluminium alloy.

15. The reinforced transom of claim 12, wherein the metallic support plate comprises a plurality of structural apertures, wherein the plurality of structural apertures occupy at least 20% of a surface area of a face of the metallic support plate.

16. The reinforced transom of claim 12, wherein the metallic support plate comprises a central longitudinally extending indented top edge section disposed between a pair of longitudinally extending outer top edge sections.

17. A reinforced, resiliently flexible transom for a double skin, moulded plastic boat body, the reinforced transom comprising:

a first exterior wall formed by plastic moulding;

a second exterior wall formed by plastic moulding;

a metallic support plate positioned between the first exterior wall and the second exterior wall, the metallic support plate comprising a plurality of connection apertures;

a metallic support brace rigidly coupled with the metallic support plate, the metallic support brace comprising a longitudinally extending bracket positioned between the second exterior wall and the metallic support plate;

a first reinforced component guard coupled with an exterior surface of the first exterior wall; and a second reinforced component guard coupled with an exterior surface of the second exterior wall;

wherein each of the plurality of connection apertures are configured to receive a corresponding projection from at least one of the first exterior wall or the second exterior wall to maintain the position of the metallic support plate during moulding of the plastic boat body;

wherein the metallic support plate and the metallic support brace are supported between the first exterior wall and the second exterior wall by a plastic foam.

18. The reinforced transom of claim 17, wherein the metallic support plate comprises a central longitudinally extending indented top edge section disposed between a pair of longitudinally extending outer top edge sections.

19. The reinforced transom of claim 18, wherein the first reinforced component guard comprises a first substantially U-shaped plate defining a first longitudinally extending upper edge, wherein the second reinforced component guard comprises a second substantially U-shaped plate defining a second longitudinally extending upper edge, wherein the first longitudinally extending upper edge and the second longitudinally extending upper edge are substantially aligned with the pair of longitudinally extending outer top edge sections of the metallic support plate.

* * * * *